US007623809B2

(12) United States Patent
Nakano et al.

(10) Patent No.: US 7,623,809 B2
(45) Date of Patent: Nov. 24, 2009

(54) IMAGE FORMING APPARATUS HAVING BELT UNIT

(75) Inventors: Hiroshi Nakano, Nagoya (JP); Hiroshi Igarashi, Nagoya (JP); Atsushi Kato, Ichinomiya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 116 days.

(21) Appl. No.: 11/476,912

(22) Filed: Jun. 29, 2006

(65) Prior Publication Data

US 2007/0177894 A1 Aug. 2, 2007

(30) Foreign Application Priority Data

Jun. 29, 2005 (JP) ..... P2005-189546

(51) Int. Cl.
*G03G 15/08* (2006.01)

(52) U.S. Cl. ..... 399/121

(58) Field of Classification Search ..... 399/107, 399/116, 117, 121, 297, 298, 299, 302, 308
See application file for complete search history.

(56) References Cited

U.S. PATENT DOCUMENTS

| | | | | |
|---|---|---|---|---|
| 5,640,661 | A | 6/1997 | Uchida et al. | |
| 7,127,201 | B2 * | 10/2006 | Takenouchi et al. | 399/297 |
| 7,526,227 | B2 * | 4/2009 | Sato et al. | 399/110 |
| 2006/0045570 | A1 * | 3/2006 | Kato et al. | 399/121 |

FOREIGN PATENT DOCUMENTS

| | | | |
|---|---|---|---|
| JP | 7-036294 | A | 2/1995 |
| JP | 8-30054 | | 2/1996 |
| JP | 8-137297 | | 5/1996 |
| JP | 2002-40753 | | 2/2002 |
| JP | 2002-372873 | A | 12/2002 |
| JP | 2004-109267 | | 4/2004 |
| JP | 2004-240403 | A | 8/2004 |

OTHER PUBLICATIONS

Japanese Office Action, w/ English translation thereof, Issued in Japanese Patent Application No. JP 2005-189646 dated Feb. 17, 2009.

* cited by examiner

*Primary Examiner*—Hoan H Tran
(74) *Attorney, Agent, or Firm*—McDermott Will & Emery LLP

(57) ABSTRACT

A plurality of image bearing members is supported by an apparatus main body and is arranged in a predetermined direction. A belt unit is configured to be detachably mounted on the apparatus main body. The belt unit includes a belt frame, a plurality of belt support rollers, a belt, and a plurality of transfer members. The plurality of belt support rollers is supported by the belt frame. The belt is movably supported by the plurality of belt support rollers and extends in the predetermined direction. Each of the plurality of transfer members is disposed in confrontation with a corresponding one of the plurality of image bearing members with the belt interposed therebetween. A positioning member fixes, relative to the apparatus main body, each of the plurality of transfer members at a position in the predetermined direction when the belt unit is mounted on the apparatus main body.

20 Claims, 10 Drawing Sheets

IMAGE FORMING APPARATUS HAVING BELT UNIT

CROSS REFERENCE TO RELATED APPLICATIONS

This application claims priority from Japanese Patent Application No. 2005-189546 filed Jun. 29, 2005. The entire content of the priority application is incorporated herein by reference.

TECHNICAL FIELD

The disclosure relates to an image forming apparatus such as a laser printer, and more particularly to an image forming apparatus having a belt unit. The disclosure also relates to a belt unit configured to be detachably mounted on an image forming apparatus.

BACKGROUND

Image forming apparatuses such as laser printers using an endless belt for conveying a paper or an endless belt for performing intermediate transfer have been conventionally known. Generally, such belt as a belt unit is detachably mounted on an apparatus main body so as to be replaced after use for a predetermined period, as disclosed in Japanese Patent Application Publication No. 2004-109267, for example. In such belt unit, at least two belt support rollers including a drive roller are supported by a belt frame and a belt is looped around the belt support rollers. A transfer member such as a transfer roller is also supported by the belt frame at a position in confrontation with a photosensitive drum disposed at the apparatus main body with the belt interposed therebetween. The transfer member is pressed against the photosensitive drum by urging means such as a spring supported by the belt frame.

SUMMARY

In a state where such belt unit is mounted on the apparatus main body, the belt unit is often positioned relative to the apparatus main body with a shaft of the drive roller as a reference position, thereby improving the accuracy of a belt conveying operation. FIGS. 1A and 1B show a configuration in which a plurality of transfer rollers is held in a resin belt frame, and photosensitive drums corresponding the transfer rollers are held in a metal main frame of the apparatus main body, More specifically, FIG. 1A shows a positional relationship between each transfer roller 100 and each photosensitive drum 101 at a normal temperature, and FIG. 1B shows the positional relationship at a high temperature. As shown in FIGS. 1A and 1B, when the temperature in the apparatus rises, the positional relationship between each transfer roller 100 and each photosensitive drum 101 may be shifted in an extending direction (front-rear direction) of a belt 102 due to the difference in linear expansion coefficient between the resin belt frame and the metal main frame. In this manner, when the relative position between the transfer roller and the corresponding photosensitive drum is shifted, a transfer position of each color on paper is also shifted, thereby causing so-called color registration.

As a preventive measure against such color shift, there is a method in which a temperature sensor for measuring temperature in the apparatus is provided and when the temperature reaches a predetermined temperature, an amount of color shift is corrected based on a mark printed on the belt. That is, a registration operation is performed. However, according to this method, an increase in the number of parts such as the temperature sensor causes cost increase and a printing operation needs to be suspended each time the registration operation is performed and thus waiting time for the user becomes longer.

In view of the foregoing, it is an object of one aspect of the invention to provide an image forming apparatus capable of improving positioning accuracy of a transfer member provided in a belt unit. It is an object of another aspect of the invention to provide a belt unit having a transfer member.

In order to attain the above and other objects, one aspect of the invention provides an image forming apparatus. The image forming apparatus includes an apparatus main body, a plurality of image bearing members, a belt unit, and a positioning member. The plurality of image bearing members is supported by the apparatus main body and is arranged in a predetermined direction. The belt unit is configured to be detachably mounted on the apparatus main body. The belt unit includes a belt frame, a plurality of belt support rollers, a belt, and a plurality of transfer members. The plurality of belt support rollers is supported by the belt frame. The belt is movably supported by the plurality of belt support rollers and extends in the predetermined direction. Each of the plurality of transfer members is disposed in confrontation with a corresponding one of the plurality of image bearing members with the belt interposed therebetween. The positioning member fixes, relative to the apparatus main body, each of the plurality of transfer members at a position in the predetermined direction when the belt unit is mounted on the apparatus main body.

Another aspect of the invention provides a belt unit. The belt unit includes a belt frame, a plurality of belt support rollers, a belt, and a transfer roller. The plurality of belt support rollers is supported by the belt frame. The belt is movably supported by the plurality of belt support rollers. The belt extends in a predetermined direction. The transfer roller is disposed in confrontation with the belt. The transfer roller has a roller shaft that extends in an axial direction and has a diameter in a radial direction. The transfer roller is rotatable about the roller shaft. The transfer roller is mounted on the belt frame so as to be capable of displacing in the radial direction.

BRIEF DESCRIPTION OF THE DRAWINGS

Illustrative aspects in accordance with the invention will be described in detail with reference to the following figures wherein.

DETAILED DESCRIPTION

<Illustrative Aspects>

An image forming apparatus and a belt unit according to illustrative aspects of the invention will be described with reference to FIGS. 2 through 6.

<Overall Configuration of a Laser Printer>

Figure 1A:
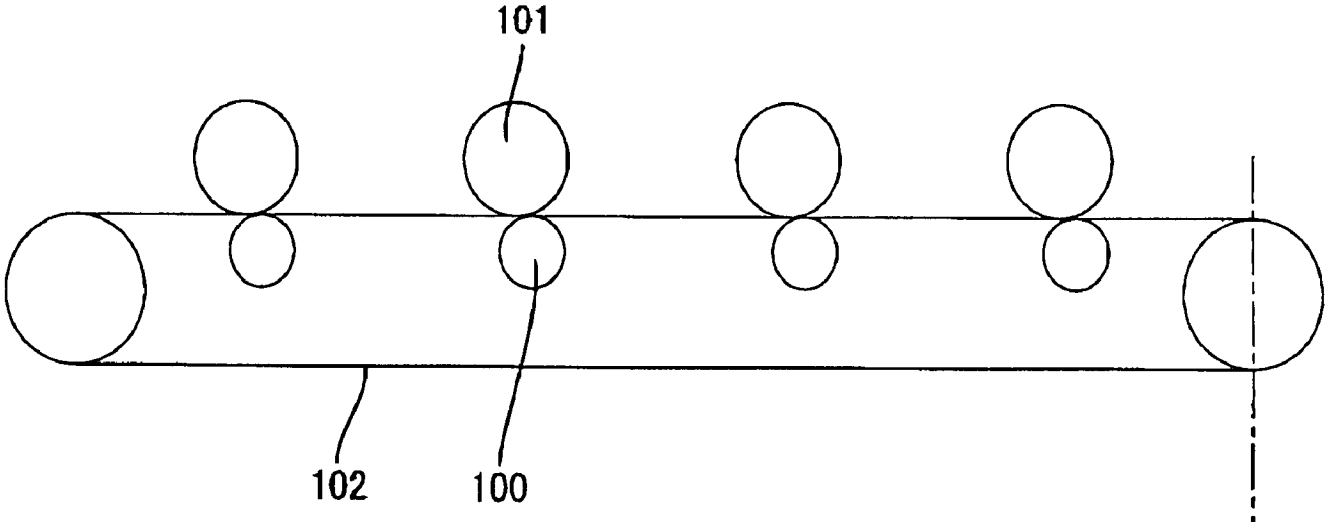
FIG. 1A is an explanatory drawing showing a positional relationship between transfer rollers and photosensitive drums at a normal temperature.
Figure 1B:
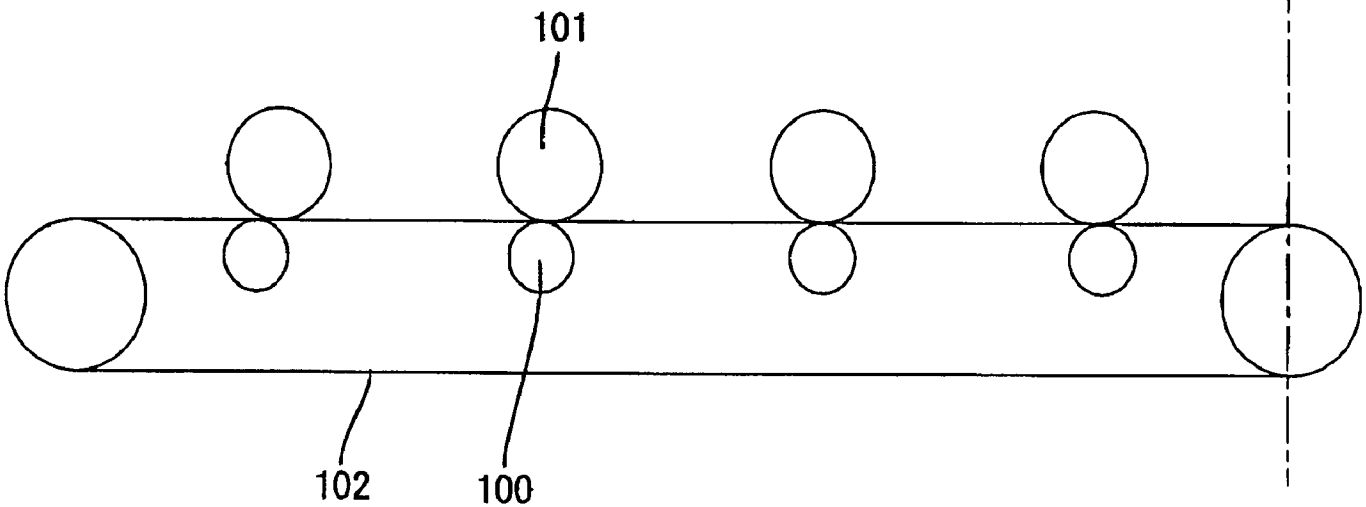
FIG. 1B is an explanatory drawing showing a positional relationship between the transfer rollers and the photosensitive drums at a high temperature.
Figure 2:
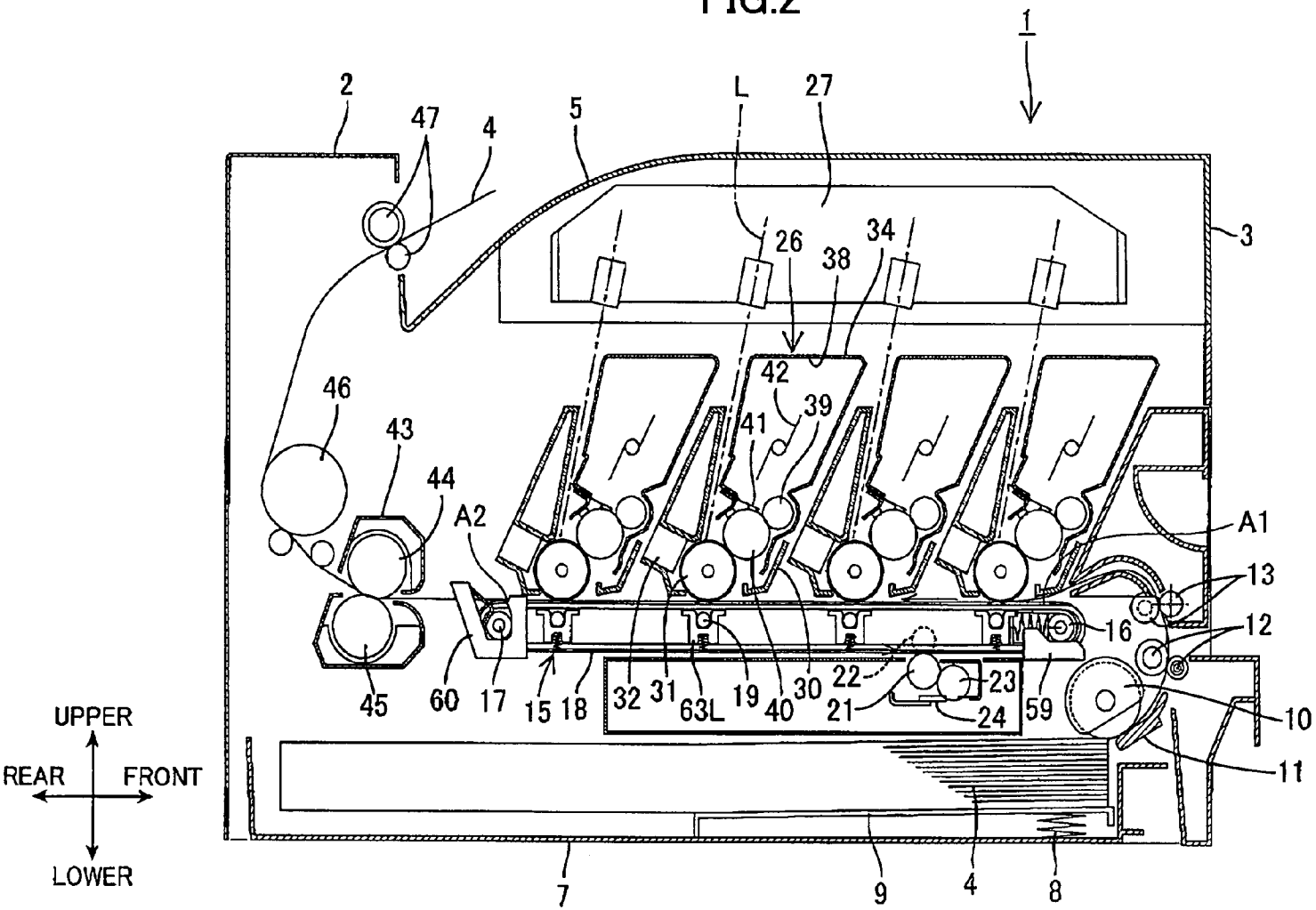
FIG. 2 is a side cross-sectional view showing a schematic configuration of a laser printer according to illustrative aspects of the invention.
Figure 3:
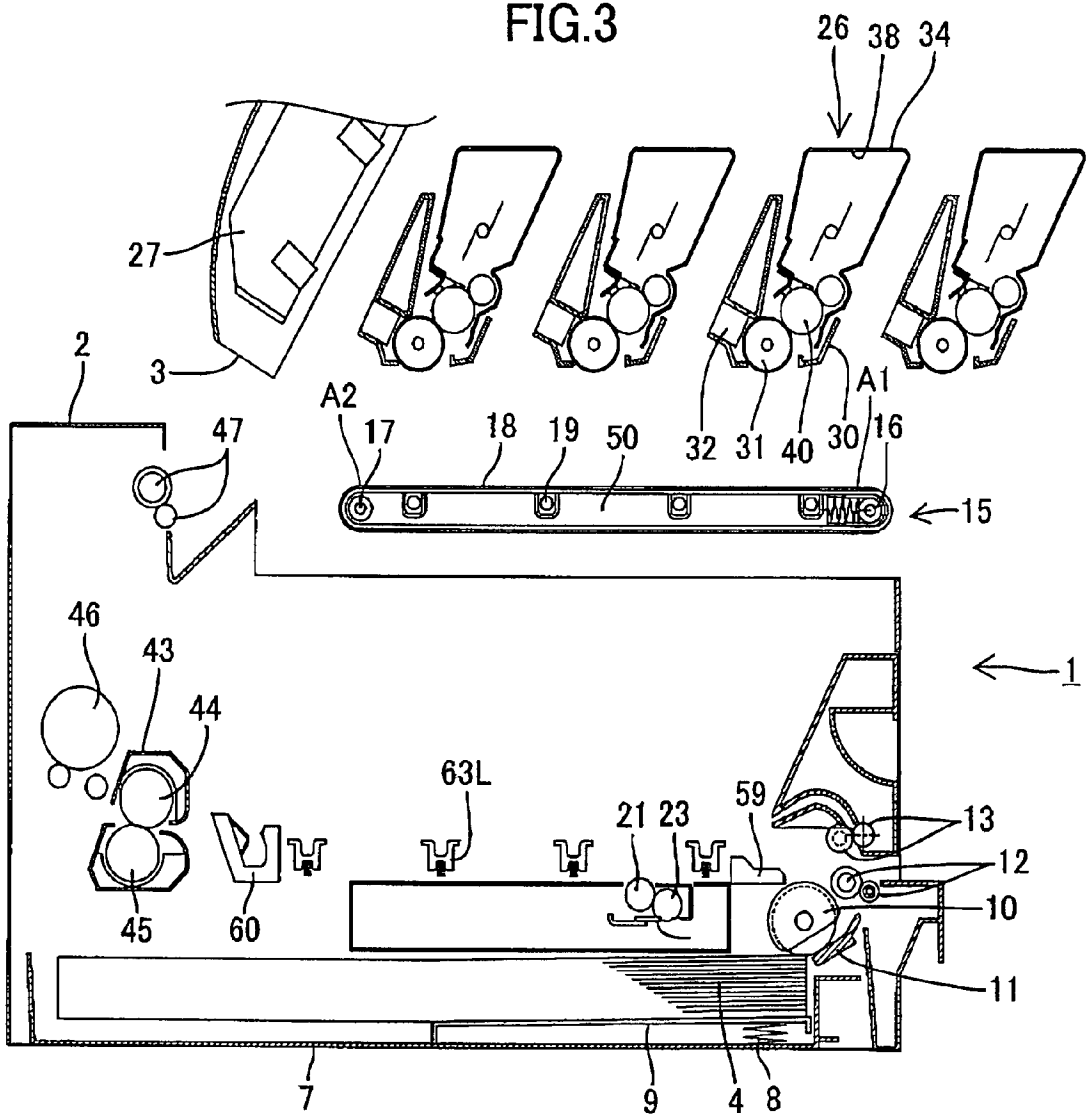
FIG. 3 is a side cross-sectional view of the laser printer in FIG. 2, from which a belt unit is dismounted.

FIG. 2 is a side cross-sectional view showing a schematic configuration of a laser printer 1 serving as an image forming apparatus according to the illustrative aspects. FIG. 3 is a side cross-sectional view of the laser printer 1 from which a process cartridge 26 and a belt unit 15 are dismounted. In the following description, the expressions "front", "rear", "upper", "lower", "right", and "left" are used to define the various parts when the image forming apparatus is disposed in an orientation in which it is intended to be used. Also, the right side in FIG. 2 is regarded as the front.

The laser printer 1 is a direct-transfer, tandem-type color laser printer. As shown in FIG. 2, the laser printer 1 has a box-like main casing 2 (an apparatus main body). An openable upper cover 3 is provided on an upper surface of the main casing 2. By opening the upper cover 3, as shown in FIG. 3, the process cartridges 26 and the belt unit 15 in the main casing 2 can be replaced. A paper discharge tray 5 is formed on the upper surface of the upper cover 3. The paper discharge tray 5 can hold a paper 4 on which an image is formed.

A paper feeding tray 7 on which sheets of paper are stacked is mounted in a lower portion of the main casing 2 so as to be capable of pulling out forward. In the paper feeding tray 7 is provided a paper pressing plate 9 which can pivotally move so as to lift a front end of the paper 4 by an urging force of a spring 8. Further, a pickup roller 10 and a separating pad 11 are provided above a front end of the paper feeding tray 7. The separating pad 11 is pressed against the pickup roller 10 by an urging force of a spring not shown. Furthermore, a pair of paper feed rollers 12 is provided diagonally upward in front of the pickup roller 10. A pair of registration rollers 13 is provided above the feeding rollers 12.

An uppermost paper 4 on the paper feeding tray 7 is pressed against the pickup roller 10 by the paper pressing plate 9. Upon rotation of the pickup roller 10, the uppermost paper 4 is sandwiched between the pickup roller 10 and the separating pad 11, thereby being separated one sheet at a time. The paper 4 sandwiched between the pickup roller 10 and the separating pad 11 is supplied to the registration rollers 13 by the paper feed rollers 12. The registration rollers 13 convey the paper 4 to the belt unit 15 (in a rearward direction) at a predetermined timing.

The belt unit 15 can be dismounted from the main casing 2. The belt unit 15 has a conveying belt 18 which horizontally extends between a pair of belt support rollers 16 and 17 which are arranged spaced away in the front-rear direction. The conveying belt 18 is an endless belt made of a resin material such as polycarbonate. The conveying belt 18 circularly moves in the counterclockwise direction by rotational driving of the rear belt support roller 17 to convey the paper 4 placed thereon rearward. Inside the conveying belt 18, four transfer rollers 19 in confrontation with photosensitive drums 31 (image bearing members) of the process cartridges 26 (described later) are arranged at regular intervals in the front-rear direction so that the conveying belt 18 is interposed between the photosensitive drums 31 and the corresponding transfer rollers 19. The conveying belt 18 has a portion defined between points A1 and A2, the portion being in confrontation with the photosensitive drums 31. The portion extends in the front-rear direction. At the transfer operation, transfer bias is applied between the transfer rollers 19 and the photosensitive drums 31. The configuration of the belt unit 15 will be described later in greater detail.

A cleaning roller 21 is provided under the belt unit 15 for removing toner, paper powders, and the like which are adhered to the conveying belt 18. The cleaning roller 21 is formed by covering a metal shaft member with a foamed material made of silicon. The cleaning roller 21 confronts a metal electrode roller 22 across the conveying belt 18. A predetermined bias is applied between the cleaning roller 21 and the electrode roller 22, thereby electrically drawing the toner and the like on the conveying belt 18 toward the cleaning roller 21. The cleaning roller 21 is also in contact with a metal collecting roller 23 for removing the toner and the like adhered to the surface of the cleaning roller 21. The collecting roller 23 is also in contact with a blade 24 for scraping the toner and the like adhered to the surface of the collecting roller 23.

Four process cartridges 26 are detachably mounted above the belt unit 15. The four process cartridges 26 correspond to four colors of magenta, yellow, cyan, and black, and are arranged in the front-rear direction. Furthermore, a scanner unit 27 is provided above the cartridges 26. The scanner unit 27 is integrally provided with the upper cover 3. The scanner unit 27 irradiates a laser beam L of each color on the respective photosensitive drums 31 based on predetermined image data through a high-speed scanning motion.

The process cartridges 26 each has a cartridge frame 30, the photosensitive drum 31 and a scorotron charger 32 which are provided in a lower portion of the cartridge frame 30, and a developing cartridge 34 detachably attached to the cartridge frame 30.

Each photosensitive drum 31 is formed by coating a surface of a grounded metal-made drum main body with a positively-charged photosensitive layer made of polycarbonate or the like. The scorotron chargers 32 are disposed diagonally upward in the rear of the corresponding photosensitive drums 31 in confrontation with the photosensitive drums 31 with a predetermined distance therebetween so as not to be in contact with each other. By generating corona discharge from a charging wire made of tungsten or the like, the scorotron chargers 32 uniformly charge the surfaces of the photosensitive drums 31 to positive polarity.

Each box-shaped developing cartridge 34 has a toner chamber 38 in its upper portion and a feeding roller 39, a developing roller 40, and a thickness regulating blade 41 below the toner chamber 38. Each toner chamber 38 accommodates a positively-charged color toner of yellow, magenta, cyan, or black containing a nonmagnetic component as a developer therein. Each toner chamber 38 is provided with an agitator 42 for agitating the toner.

Each feeding roller 39 is formed by covering a metal roller shaft with a conductive foamed material. Each developing roller 40 is formed by covering a metal roller shaft with a conductive rubber material. The toner discharged from the toner chamber 38 is supplied to the developing roller 40 by the rotation of the feeding roller 39. At this time, the toner is tribo-charged to positive polarity between the feeding roller 39 and the developing roller 40. With the rotation of the developing roller 40, the toner supplied to the developing roller 40 enters between the thickness regulating blade 41 and the developing roller 40 and is further tribo-charged to be borne on the developing roller 40 as a thin layer of a certain thickness.

During the rotation of the photosensitive drum 31, first, the surface of the photosensitive drum 31 is positively-charged uniformly by the scorotron chargers 32. Then, the surface is exposed by high-speed scanning of the laser beam sent from the scanner unit 27 to form an electrostatic latent image corresponding to an image to be formed on the paper 4.

Next, when the rotating developing roller 40 comes into contact with the photosensitive drum 31 in confrontation with each other, the positively-charged toner borne on the developing roller 40 is supplied to the electrostatic latent image on the photosensitive drum 31. Thus, the electrostatic latent image on the photosensitive drum 31 is made visible and a toner image by reversal development is borne on the surface of the photosensitive drum 31.

Subsequently, while the paper 3 conveyed by a conveying belt 18 (described later) passes each of transfer positions located between the photosensitive drums 31 and the transfer rollers 39, the toner image borne on the surface of each photosensitive drum 31 is sequentially transferred onto the paper 4 by negative transfer bias applied to the transfer rollers 39. Then, the paper 4 on which the toner images are transferred is conveyed to a fixing unit 43.

The fixing unit 43 is disposed in the rear of the conveying belt 18 in the main casing 2. The fixing unit 43 has a heating roller 44 which has a heat source such as a halogen lump and is rotationally driven, and a pressing roller 45 which is disposed below the heating roller 44 in confrontation with the same so as to press the heating roller 44 and is driven following the rotation of the heating roller 44. The fixing unit 43 heats the paper 4 which bears the toner images of four colors thereon while conveying the paper 4 between the heating roller 44 and the pressing roller 45 to fix the toner images on the paper 4. The thermally-fixed paper 4 is conveyed to paper discharge rollers 47 provided in the upper portion of the main casing 2 by a conveying roller 46 disposed diagonally upward in the rear of the fixing unit 43. Then, the paper 4 is discharged onto the paper discharge tray 5 by the paper discharge rollers 47.

<Belt unit and positioning structure>

Figure 4A:
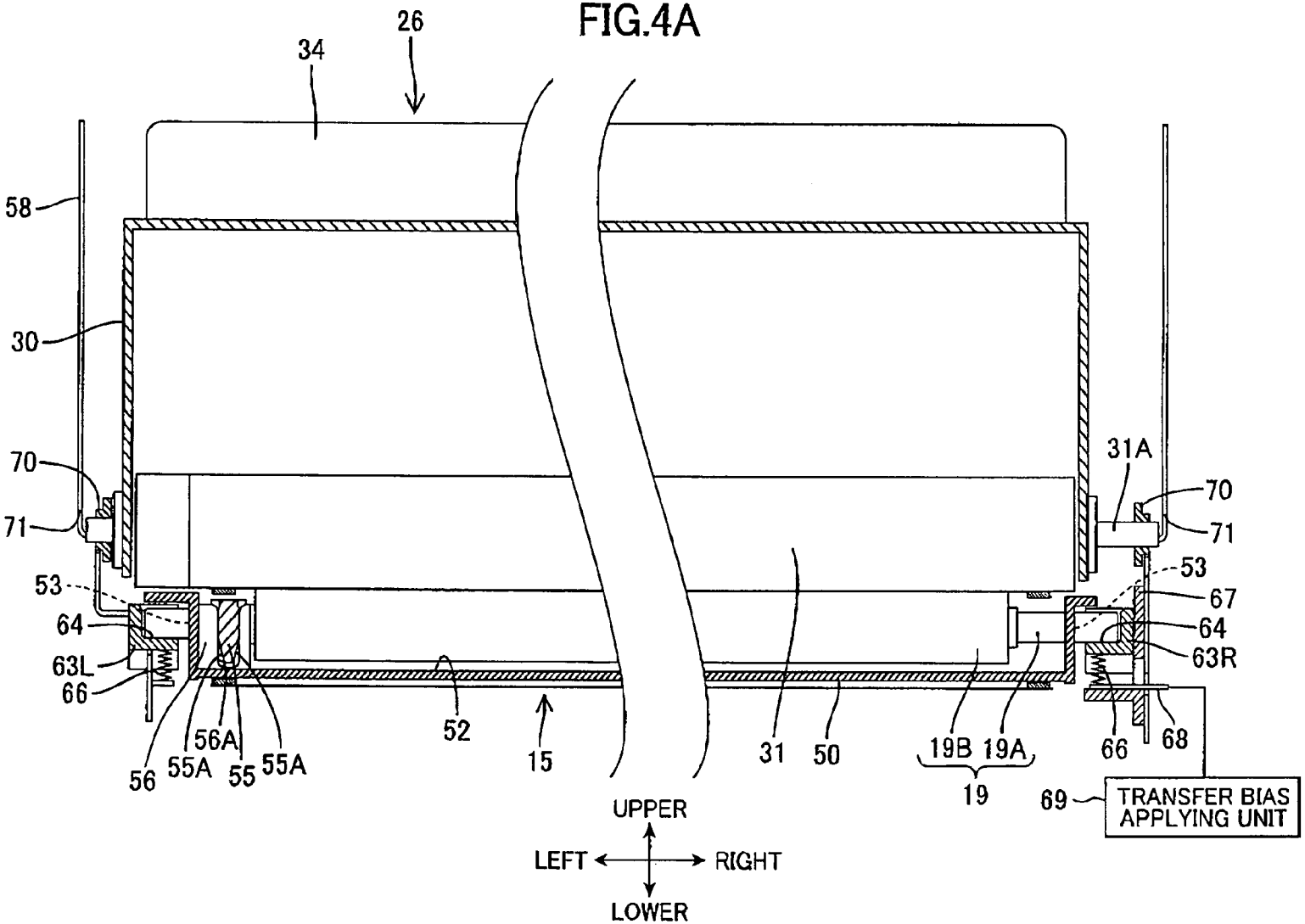
FIG. 4A is a front cross-sectional view showing a support structure of a transfer roller and a photosensitive drum.
Figure 4B:
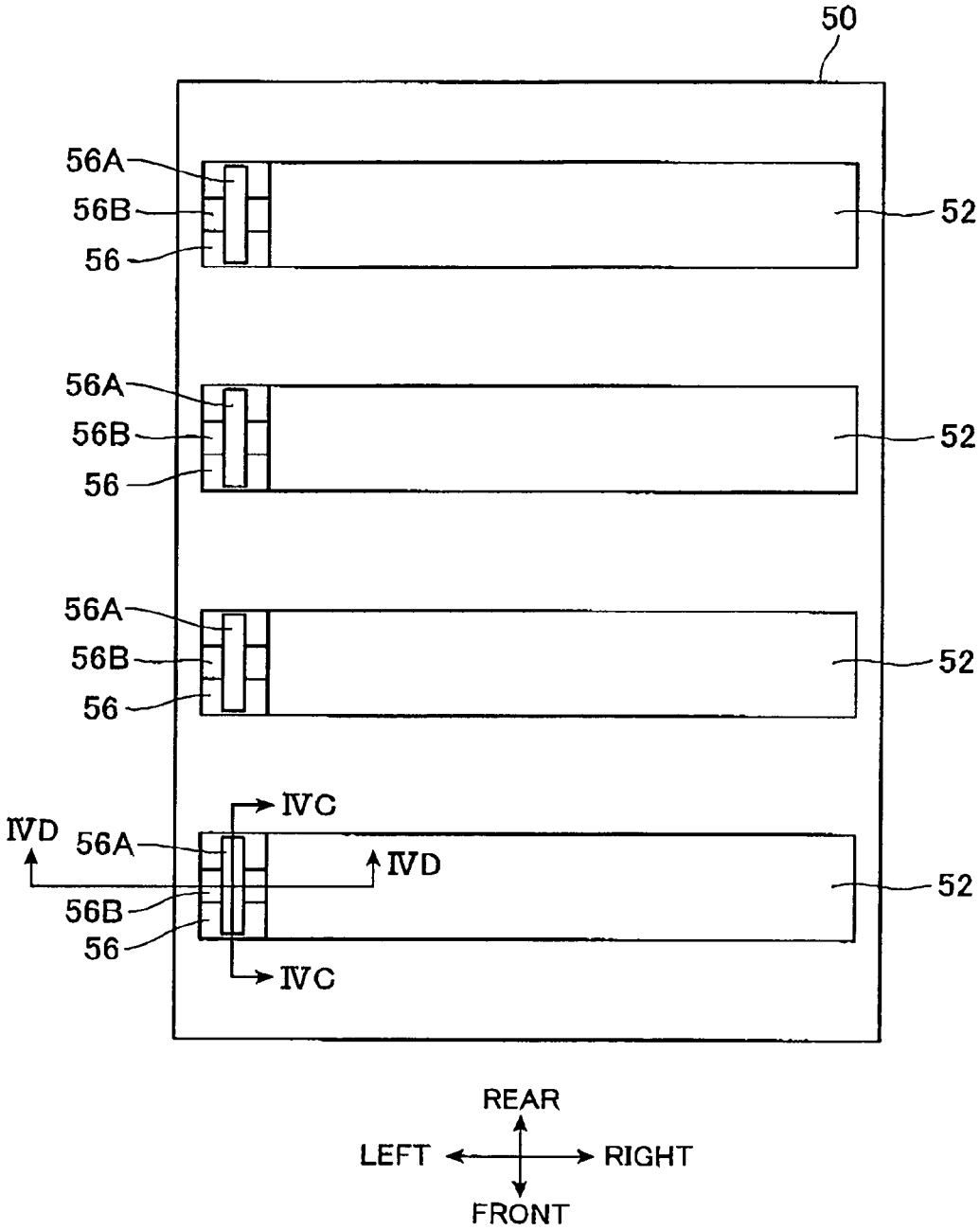
FIG. 4B is a top plan view of a belt frame shown in FIG. 4A.
Figure 4C:
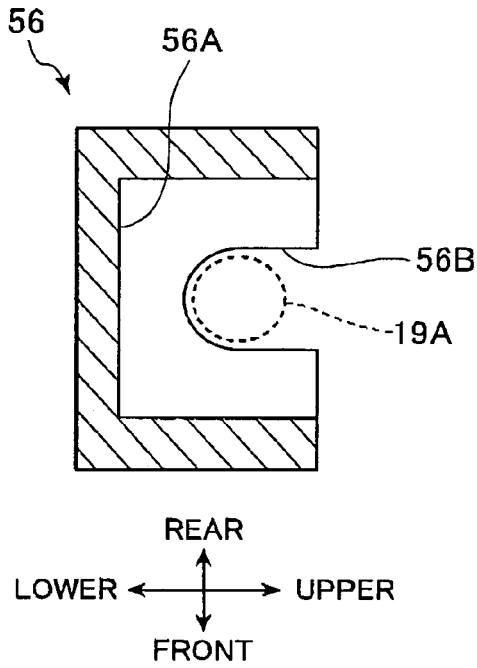
FIG. 4C is an enlarged cross-sectional view showing a construction of a groove member, taken along a line IVC-IVC in FIG. 4B.
Figure 4D:
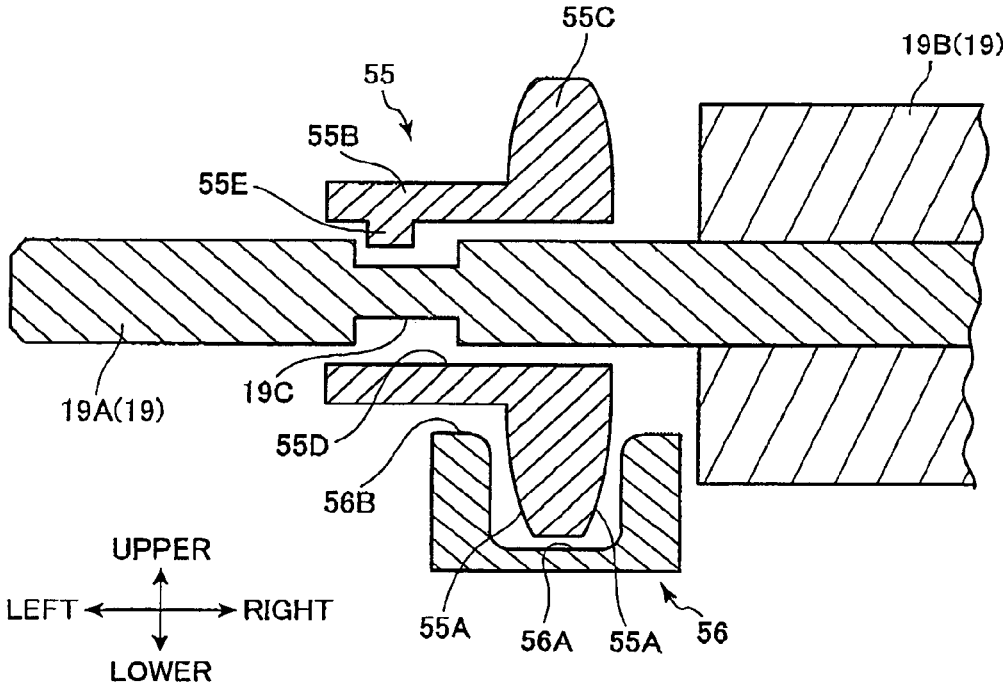
FIG. 4D is an enlarged cross-sectional view showing a state in which a regulating member and transfer roller are mounted on the belt frame, taken along a line IVD-IVD in FIG. 4B.
Figure 5:
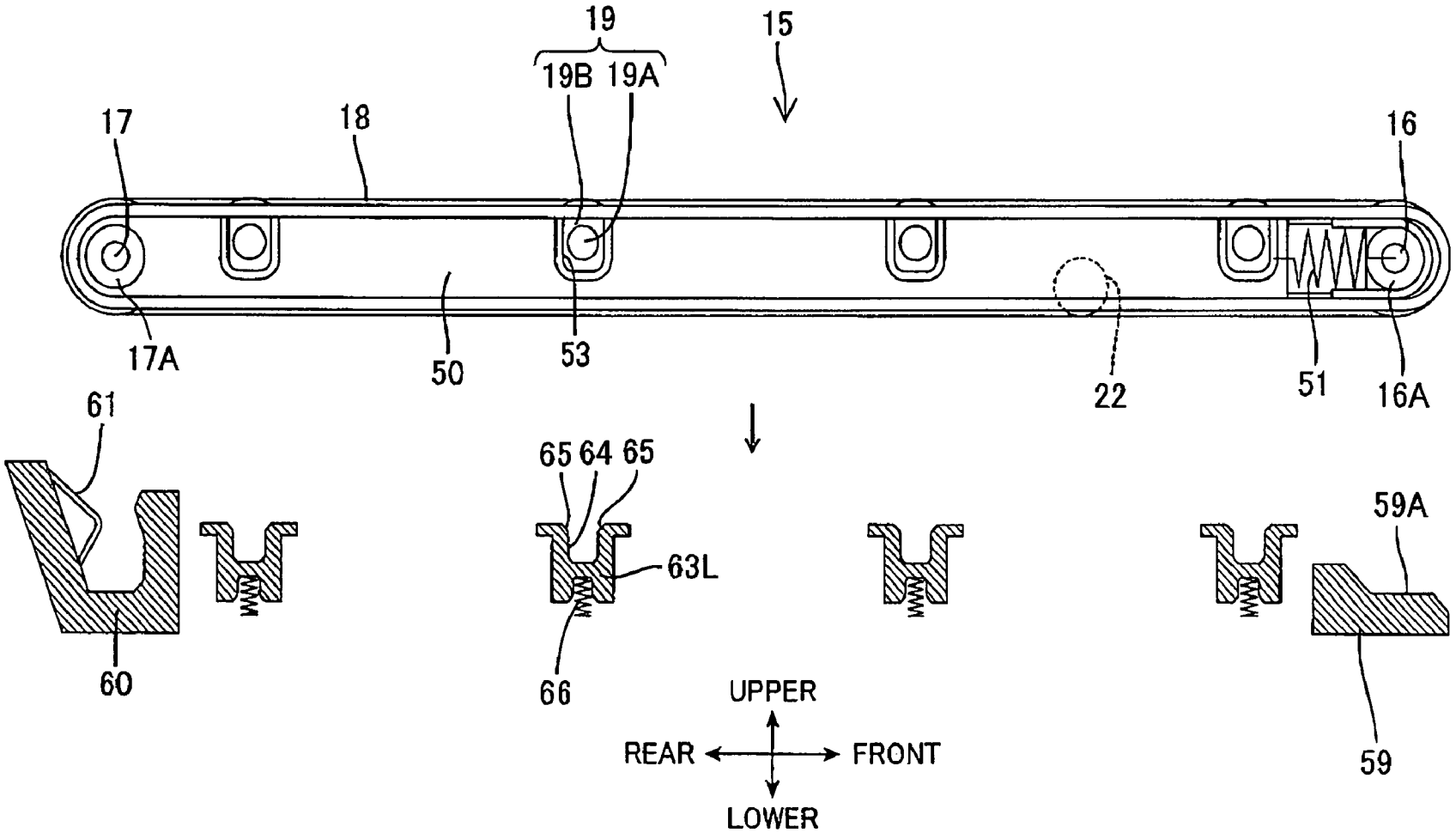
FIG. 5 is a side cross-sectional view showing the belt unit before the belt unit is mounted on unit support parts.
Figure 6:
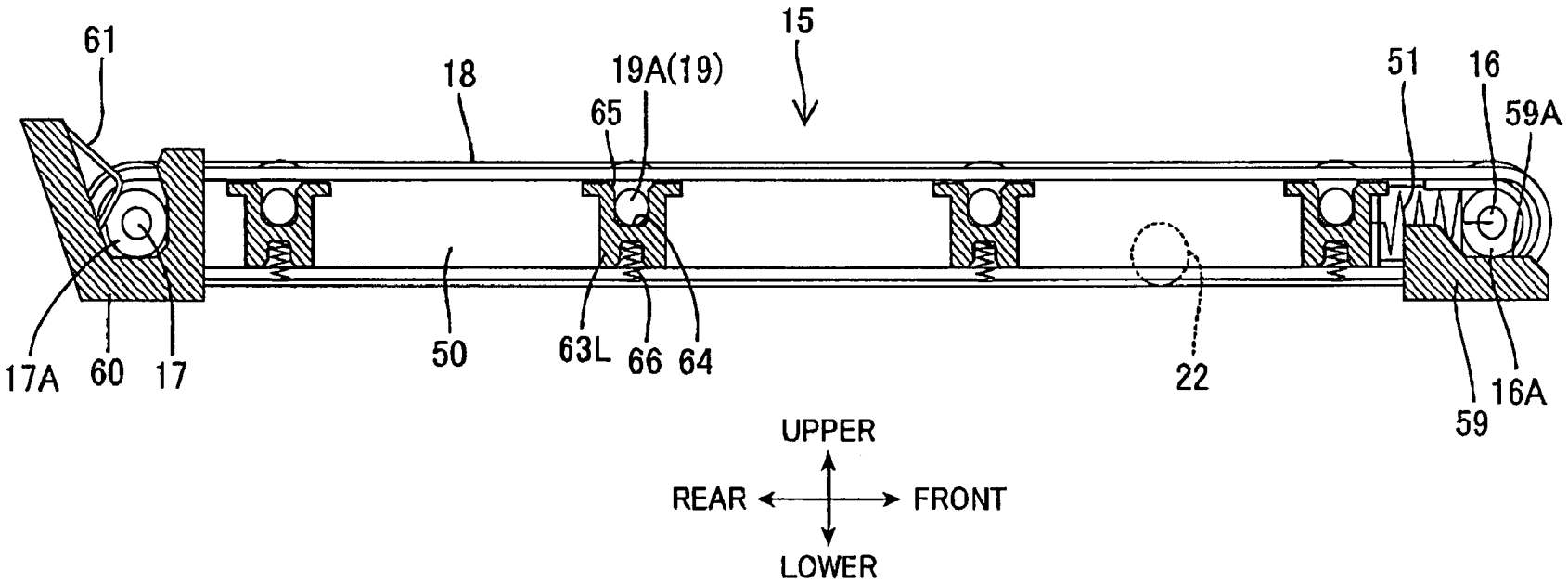
FIG. 6 is a side cross-sectional view showing the belt unit after the belt unit is mounted on the unit support parts.

FIG. 4A is an enlarged cross-sectional view showing part in the main casing 2 (showing a support structure of the transfer roller 19 and photosensitive drum 31), as viewed from the front. FIG. 4B is a top plan view of a belt frame 50 shown in FIG. 4A. FIG. 4C is an enlarged cross-sectional view showing a construction of a groove member 56, taken along a line IVC-IVC in FIG. 4B. FIG. 4D is an enlarged cross-sectional view showing a state in which a regulating member 55 and transfer roller 19 are mounted on the belt frame, taken along a line IVD-IVD in FIG. 4B. FIG. 5 is a side cross-sectional view showing the belt unit 15 before the belt unit 15 is mounted on unit supporting parts 59 and 60. FIG. 6 is a side cross-sectional view showing the belt unit 15 after the belt unit 15 is mounted on the unit supporting parts 59 and 60.

As shown in FIGS. 4A, 4B, and 5, the belt unit 15 has the belt frame 50 which is made of an insulating synthetic resin material and which is shaped like a rectangular flat plate as a whole. The rear belt support roller 17 (FIG. 5) is supported by a rear end of the belt frame 50. When the belt unit 15 is mounted on the main casing 2, the rear belt support roller 17 is connected to a gear mechanism (not shown) provided in the main casing 2 and is driven by a rotational force of a motor (not shown) provided in the main casing 2. The front belt support roller 16 is supported by a front end of the belt frame 50 with being urged forward by a spring 51. Thus, a suitable tensile force is applied to the conveying belt 18. The metal electrode roller 22 (FIG. 2) is rotatably supported by a lower portion of the belt frame 50. The electrode roller 22 is grounded when the belt unit 15 is mounted on the main casing 2.

As shown in FIGS. 4A through 4C, in the belt frame 50, four transfer-roller mounting grooves 52 each extending in the left-right direction and opened upward are arranged in the front-rear direction. Each transfer-roller mounting groove 52 accommodates the transfer roller 19. The groove member 56 is provided in each transfer-roller mounting groove 52 at the left end. The groove member 56 is formed with a groove 56A that extends in the front-rear direction and is opened upward. The groove member 56 is also formed with a substantially semicircle-shaped shaft receiving part 56B (FIG. 4C) for receiving a roller shaft 19A of the transfer roller 19.

As shown in FIGS. 4A and 4D, the transfer roller 19 is formed by covering the metal roller shaft 19A with a conductive rubber member 19B. The roller shaft 19A protrudes outward from right and left ends of the rubber member 19B. The roller shaft 19A is formed with a notched part 19C (FIG. 4D) having a smaller diameter than the other part of the roller shaft 19A.

As shown in FIGS. 4A and 5, roller-shaft insertion holes 53 are formed on right and left side surfaces of the belt frame 50 at four front-rear positions corresponding to the transfer-roller mounting grooves 52. As shown in FIG. 5, the roller shafts 19A of the transfer rollers 19 are loosely inserted into the roller-shaft insertion holes 53. Each roller-shaft insertion hole 53 has a substantially rectangular shape and has a size in the upper-lower (vertical) and front-rear directions which is larger than an outer diameter of the roller shaft 19A. In a state where the belt unit 15 is dismounted from the main casing 2, the roller shaft 19A can be displaced (moved) within the roller-shaft insertion holes 53 in the radial directions (upper-lower and front-rear directions).

As shown in FIGS. 4A and 4D, the regulating member 55 is provided on the belt frame 50 at the left end. The regulating member 55 has a cylindrical part 55B extending in the axial direction of the roller shaft 19A and a pair of plate-like regulating parts 55C extending from the cylindrical part 55B in the front-rear and upper-lower directions (the radial directions of the roller shaft 19A). The plate-like regulating part 55C has convex surfaces 55A having an arc-like cross section as right and left side surfaces. The regulating member 55 is formed with a shaft hole 55D that extends in the axial direction. A shaft-hole protruding part 55E is provided on the cylindrical part 55B to protrude into the shaft hole 55D. The roller shaft 19A is inserted into the shaft hole 55D of the regulating member 55, such that the shaft-hole protruding part 55E is positioned in the notched part 19C. With this configuration, the regulating member 55 is rotatable about the axis relative to the roller shaft 19A, but not movable relative to the roller shaft 19A in the axial direction when the belt unit 15 is mounted on the main casing 2. When the belt unit 15 is not mounted on the main casing 2, the roller shaft 19A is movable in the axial direction by an amount of a gap between the convex surfaces 55A and the groove 56A and a gap between the shaft-hole protruding part 55E and the notched part 19C.

With this configuration, the plate-like regulating part 55C of the regulating member 55 is fitted in the groove 56A. The right and left convex surfaces 55A come into contact with an inner wall of the groove 56A, thereby axially positioning the transfer roller 19 and allowing the roller shaft 19A to slidingly move in the radial directions (upper-lower and front-rear directions). Hence, the roller shaft 19A is allowed to incline in the radial directions (i.e., incline from a reference axial direction).

On the-other hand, as shown in FIG. 4A, a metal main frame 58 (a holding member) is provided in the main casing 2 for covering the right and left sides of the process cartridges 26 and the belt unit 15. The main frame 58 is fixedly provided at the main casing 2. A pair of front and rear unit supporting parts 59 and 60 made of synthetic resin for supporting both ends of each of the belt support rollers 16 and 17 is mounted on the main frame 58. The rear unit supporting part 60 has a substantially squared-C shaped cross section opened upward. A retaining metal fitting 61 is provided at an opening of the unit supporting part 60. The retaining metal fitting 61 is elastically deformable and has an angular cross section so as to protrude inward. As shown in FIG. 6, a bearing 17A for rotatably supporting an end of the rear belt support roller 17 is fitted in the unit supporting part 60. The bearing 17A is prevented from coming off by the retaining metal fitting 61, thereby holding the belt support roller 17 in the positioned state. The front unit supporting part 59 has a flat surface 59A of a certain height as a partial upper surface. By placing the bearing 16A for rotatably supporting the end of the front belt support roller 16 on the flat surface 59A, the belt support roller 16 is positioned in the height direction (upper-lower direction) and held at the position. The flat surface 59A of the front unit supporting parts 59 can allow displacement of the belt support roller 16 in the front-rear direction. As shown in FIGS. 4A and 5, a left bearing member 63L and a right bearing member 63R are provided at the main frame 58 for each transfer roller 19. The left bearing member 63L and the right bearing member 63R rotatably support the roller shaft 19A of the transfer roller 19. Each of the bearing members 63L and 63R has a bearing groove 64 opened upward. The roller shaft 19A is rotatably supported by fitting the end of the roller shaft 19A into the bearing grooves 64 from above. As shown in FIG. 5, guiding faces 65 for guiding the roller shaft 19A into the bearing groove 64 are formed on an opening edge of each bearing groove 64. As shown in FIG. 4A, the left bearing member 63L (the left-side bearing member when viewed from the front) is made of an insulating synthetic resin material. The left bearing member 63L can be vertically displaced relative to the main frame 58, and is supported in a positioned state relative to the main frame 58 in the front-rear and left-right directions. A spring 66 (urging member) is attached to the lower end of the bearing member 63L for urging the left bearing member 63L upward.

The right bearing member 63R (the right-side bearing member when viewed from the front) is made of a conductive synthetic resin material. The right bearing member 63R can be vertically displaced relative to an insulating member 67 fixed to the main frame 58. The right bearing member 63R is supported in a positioned state relative to the insulating member 67 in the front-rear and left-right directions. A spring 66 is attached to the lower end of the bearing member 63R for urging the bearing member 63R upward. One end of an electrode plate 68 is connected to a lower end of the spring 66. Another end of the electrode plate 68 extends to outside of the main frame 58 and is connected to a transfer bias applying unit 69 provided in the main casing 2. The transfer bias applying unit 69 is electrically connected to the transfer roller 19 via the electrode plate 68, the spring 66, and the bearing member 63R. During an image forming operation, the transfer bias applying unit 69 applies transfer bias between the transfer rollers 19 and the photosensitive drums 31.

On the other hand, as shown in FIG. 4A, each photosensitive drum 31 has a drum shaft 31A extending from both ends of the drum main body. A bearing member 70 made of synthetic resin is rotatably provided on the outer circumference of each end of the drum shaft 31A. Right and left drum positioning grooves 71 are provided at the main frame 58 for each photosensitive drum 31. By fitting the bearing member 70 into each of the right and left drum positioning grooves 71, the drum shaft 31A is rotatably supported by the main frame 58 in a positioned state. The drum shaft 31A is connected to a gear mechanism (not shown) provided in the main casing 2, such that the photosensitive drum 31 can be driven by a rotational force generated by a motor (not shown). As described above, each transfer roller 19 is positioned by the metal main frame 58 and supported in a positioned state. Also, each photosensitive drum 31 is positioned by the metal main frame 58 and supported in a positioned state. In other words, both of the transfer rollers 19 and the photosensitive drums 31 are positioned by the metal main frame 58. With this configuration, when the temperature of the belt frame 50 is changed by 30 degrees Celsius (for example, from 10 to 40 degrees Celsius), a change in the position of the transfer roller 19 relative to the photosensitive drum 31 in the front-rear direction (belt extending direction) is less than or equal to 50 micrometers.

For example, in order to replace the conveying belt 18, as shown in FIG. 3, the upper cover 3 is opened, the process cartridges 26 are pulled out, and then the belt unit 15 is removed from the main casing 2. To mount the belt unit 15 on the main casing 2, as shown in FIG. 5, the belt unit 15 is lowered in a horizontal orientation, and the bearing 17A of each end of the rear belt support roller 17 is pressed into the unit supporting part 60. At the same time, the bearing 16A of each end of the front belt support roller 16 is placed on the unit supporting parts 59. In this manner, as shown in FIG. 6, the belt unit 15 is supported in a horizontal orientation by the front and rear unit supporting parts 59 and 60. In this process, the roller shaft 19A of each transfer roller 19 is guided by the guiding face 65 and the both ends of the roller shaft 19A are fitted into the bearing grooves 64 of the bearing members 63L and 63R. Thus, each transfer roller 19 is positioned in the front-rear direction relative to the main frame 58 via the bearing members 63L and 63R.

Subsequently, each process cartridge 26 is mounted above the belt unit 15. At this time, the photosensitive drum 31 is positioned relative to the main frame 58 by fitting the bearing members 70 attached to both ends of the drum shaft 31A into the drum positioning grooves 71 of the main frame 58. Because the transfer roller 19 is pressed downward by the photosensitive drum 31 against the urging force of the springs 66, the transfer roller 19 is positioned in the upper-lower direction as well.

<Effects of the illustrative aspects>

In the illustrative aspects described above, each transfer roller 19 provided at the belt unit 15 is positioned by the bearing members 63L and 63R provided at the main casing 2. Hence, the positioning accuracy of the transfer roller 19 relative to the photosensitive drum 31 supported by the main casing 2 can be improved. Thus, an occurrence of color shift can be prevented and a better image quality can be achieved.

The springs 66 for pressing the transfer rollers 19 against the photosensitive drums 31 are provided in the main casing 2. Hence, the pressing force of the springs 66 need not be supported by the belt frame 50. Therefore, as compared with the case where the springs are provided at the belt unit, rigidity of the belt frame 50 can be lowered, thereby reducing the size of the belt unit 15 as a whole.

The transfer bias applying unit 69 provided in the main casing 2 applies a transfer bias between the photosensitive drums 31 and the transfer rollers 19. Thus, toner images borne on the photosensitive drums 31 can be electrostatically transferred onto paper conveyed by the conveying belt 18.

The transfer member is configured by the transfer rollers 19. Hence, driving of the belt can be performed more smoothly as compared with the case where transfer brushes or transfer blades are used as the transfer member.

Since the positioning member is configured by the bearing members 63L and 63R for rotatably supporting the roller shaft 19A, the transfer roller 19A can be positioned without preventing the rotation of the transfer roller 19.

The transfer roller 19 is displaceably (movably) assembled to the belt frame 50 without being fixed in the radial direction of the roller shaft 19A. Hence, when the belt unit 15 is mounted on the main casing 2, the transfer roller 19 can be positioned by the positioning member on the main casing 2 (bearing members 63L and 63R).

By fitting the plate-like regulating member 55 extending from the end of the roller shaft 19A into the groove 56A of the belt frame 50, the transfer roller 19 can be positioned in the axial direction while allowing the radial displacement of the transfer roller 19, Since the contact surface of the regulating member 55 against the inner wall of the groove 56A forms the convex surfaces 55A having an arc-like cross section, friction generated between the regulating member 55 and the inner wall of the groove 56A can be reduced. Thus, when the belt unit 15 is mounted, the transfer roller 19 smoothly moves in the radial directions of the roller shaft 19A and, at the same time, is positioned in the axial direction.

Since the belt frame 50 is made of synthetic resin, the belt frame 50 can be manufactured at low cost. The conductive parts such as the transfer roller 19 and the electrode roller 22 can be electrically isolated with ease.

Since the bearing members 63L and 63R for positioning the photosensitive drums 31 and the transfer rollers 19 are supported by a member made of the same material having the same linear expansion coefficient (i.e., main frame 58) in a positioned state, the positioning accuracy of the photosensitive drums 31 with respect to the transfer rollers 19 can be improved.

Furthermore, since both the photosensitive drums 31 and the bearing members 63L and 63R are positioned by the metal-made main frame 58, positioning can be performed at high accuracy.

A positional shift of the transfer rollers 19 relative to the photosensitive drums 31 in the belt extending direction (in the front-rear direction) in response to temperature change of 30 degrees Celsius is less than or equal to 50 micrometers. Here, the positional shift of 50 micrometers is obtained, according to Dory's approximation formula, as a limit that the human's retina cannot sense a positional shift in an image on a sheet at a distance of 300 millimeters. The distance of 300millimeters is a standard observation distance that is prescribed in ISO 13660. Refer to "Fine Imaging and Hard Copy" copublished by Society of Photographic Science and Technology of Japan and The Imaging Society of Japan, 1st edition, Corona Publishing Co., Ltd, Jun. 7, 1999, p 527, for example. A temperature change of the belt frame 50 at printing is generally 30 degrees Celsius at maximum. Therefore, with the above-described configuration, even when the transfer roller 19 is displaced with respect to the photosensitive drum 31 due to the temperature change, the displacement of the image on the paper 4 can be suppressed to the extent the displacement cannot be recognized with the naked eye.

<Additional aspects>

Next, an image forming apparatus and a belt unit according to additional aspects of the invention will be described with reference to FIGS. 7 and 8, wherein like parts and components are designated by the same reference numerals to avoid duplicating description.

Figure 7:
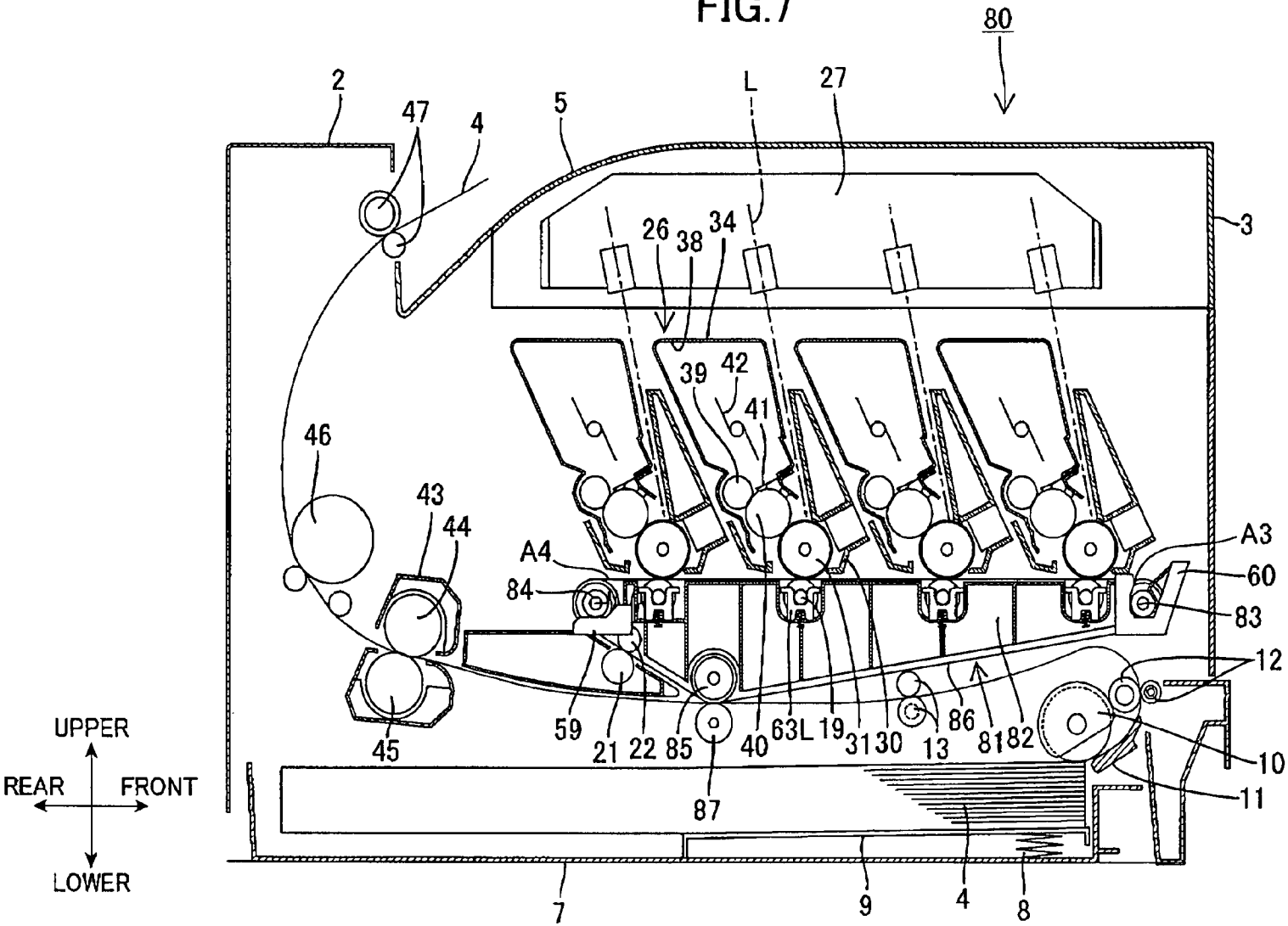
FIG. 7 is a side cross-sectional view showing a schematic configuration of a laser printer according to additional aspects of the invention.
Figure 8:
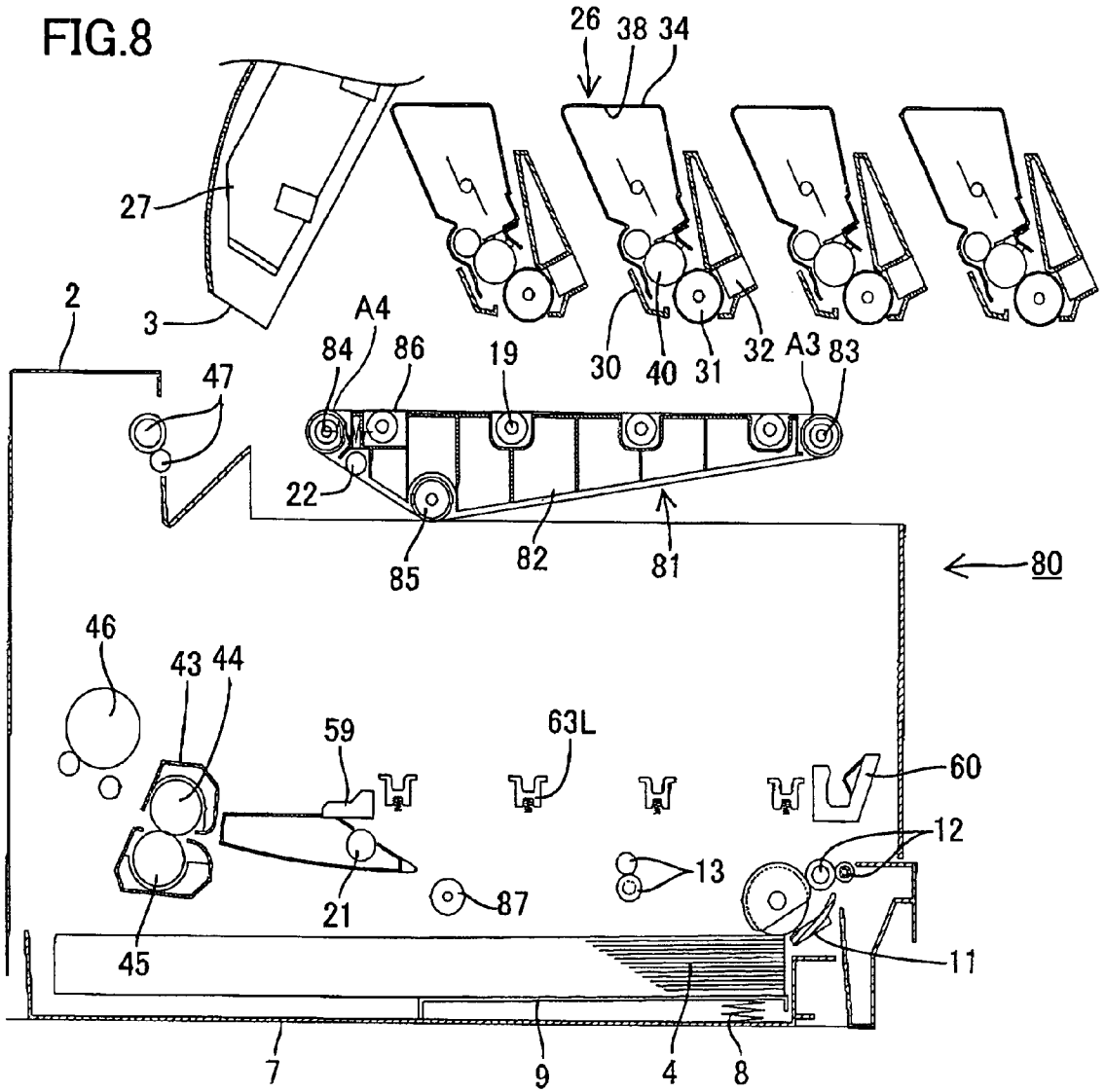
FIG. 8 is a side cross-sectional view of the laser printer in FIG. 7, from which a belt unit is dismounted.

FIG. 7 is a side cross-sectional view showing a schematic configuration of a laser printer 80 serving as an image forming apparatus according to the additional aspects. FIG. 8 is a side cross-sectional view of the laser printer 80 from which the process cartridges 26 and a belt unit 81 are dismounted. In the following description, the right side in FIG. 7 is regarded as the front.

The laser printer 80 according to the additional aspects is an intermediate-transfer tandem-type color laser printer having an intermediate transfer belt 86.

The laser printer 80 has the belt unit configured to be dismounted from the main casing 2. The belt unit 81 has a belt frame 82 that is formed of an insulating synthetic resin material and that has a substantially triangular shape when viewed from the side. The intermediate transfer belt 86 has a portion defined between points A3 and A4, the portion being in confrontation with the photosensitive drums 31. The portion extends in the front-rear direction. The belt support roller 83, 84, and 85 are provided at a front end, a rear end, and a lower end of the belt frame 82, respectively. The intermediate transfer belt 86 is supported around the belt support rollers 83, 84, and 85. The four transfer rollers 19 are arranged on an upper portion of the belt frame 82. A secondary transfer roller 87 is provided below the belt unit 81. The secondary transfer roller 87 is positioned in confrontation with the belt support roller 85 located at the lower end of the belt frame 82 across the intermediate transfer belt 86. A secondary transfer bias is applied between the secondary transfer roller 87 and the belt support roller 85. In the laser printer 80, toner images in four colors on the four photosensitive drums 31 are temporarily transferred onto the intermediate transfer belt 86. Then, when the paper 4 passes a contact position between the secondary transfer roller 87 and the intermediate transfer belt 86, the toner images on the intermediate transfer belt 86 are transferred onto the paper 4. The front and rear unit supporting parts 60 and 59 for supporting the front and rear belt support rollers 83 and 84, respectively, are provided at a main frame (not shown) in the main casing 2. Further, the left and right bearing members 63L and 63R for supporting the roller shaft 19A of each transfer roller 19 are provided at the main frame.

According to the additional aspects, the positioning accuracy of the transfer rollers 19 can be improved in the intermediate-transfer image forming apparatus.

While the invention has been described in detail with reference to the above aspects thereof, it would be apparent to those skilled in the art that various changes and modifications may be made therein without departing from the spirit of the invention.

(1) In the above-described aspects, the transfer rollers and the photosensitive drums are supported by a same single part in a positioned state. However, it is possible that positioning means for positioning image bearing members is supported by one part and that positioning means for positioning transfer members is supported by another part. Here, it is preferable that the one part and the another part are made of a same material having a same linear expansion coefficient.

(2) In the above-described aspects, transfer rollers are used as transfer members. However, transfer brushes or transfer blades may be used as the transfer members.

What is claimed is:

1. An image forming apparatus comprising:

an apparatus main body;

a plurality of image bearing members supported by the apparatus main body and arranged in a predetermined direction;

a belt unit configured to be detachably mounted on the apparatus main body, the belt unit including:

a belt frame;

a plurality of belt support rollers supported by the belt frame;

a belt movably supported by the plurality of belt support rollers and extending in the predetermined direction; and a plurality of transfer members each disposed in confrontation with a corresponding one of the plurality of image bearing members with the belt interposed therebetween; and a positioning member that fixes, relative to the apparatus main body, each of the plurality of transfer members at a position in the predetermined direction when the belt unit is mounted on the apparatus main body.

2. The image forming apparatus according to claim 1, further comprising a plurality of urging members provided at the apparatus main body, each urging member urging a corresponding one of the plurality of transfer members toward the plurality of image bearing members.

3. The image forming apparatus according to claim 1, further comprising a transfer bias applying unit provided at the apparatus main body, the transfer bias applying unit being electrically connected to the plurality of transfer members and applying a transfer bias between each transfer member and the corresponding one of the plurality of image bearing members.

4. The image forming apparatus according to claim 1, wherein each transfer member comprises a transfer roller having a roller shaft that extends in an axial direction and that has a diameter in a radial direction, the transfer roller being rotatable about the roller shaft.

5. The image forming apparatus according to claim 4, wherein the positioning member comprises a bearing member that rotatably supports the roller shaft.

6. The image forming apparatus according to claim 4, wherein the transfer roller is loosely mounted on the belt frame so as to be capable of displacing along the radial predetermined direction.

7. The image forming apparatus according to claim 6, wherein the belt frame is formed with a roller-shaft insertion hole, the roller-shaft insertion hole having a size in the radial predetermined direction that is larger than the diameter of the roller shaft.

8. The image forming apparatus according to claim 6, wherein the belt unit includes a regulating member that is provided at an end of the roller shaft and that extends in the radial direction; and wherein the belt frame is formed with a groove having an inner surface, the regulating member being configured to be fitted in the groove such that the regulating member is positioned with respect to the axial direction.

9. The image forming apparatus according to claim 8, wherein the regulating member has a contact surface that contacts the inner surface of the groove, the contact surface having a convex shape.

10. The image forming apparatus according to claim 1, wherein the belt is a conveying belt that conveys a sheet-like medium to positions in confrontation with the plurality of image bearing members.

11. The image forming apparatus according to claim 1, wherein the belt is an intermediate transfer belt onto which a developer image is transferred from the plurality of image bearing members, the intermediate transfer belt transferring the developer image onto a sheet-like medium.

12. The image forming apparatus according to claim 1, wherein the belt frame is formed of a synthetic resin material.

13. The image forming apparatus according to claim 1, further comprising a holding member provided at the apparatus main body, the holding member being made of one material, the holding member supporting the plurality of image bearing members and the positioning member in a state where the plurality of image bearing members and the positioning member are fixed at positions.

14. The image forming apparatus according to claim 13, wherein the holding member comprises a metal frame.

15. The image forming apparatus according to claim 1, wherein a shift in a position of each transfer member relative to the corresponding one of the plurality of image bearing members in the predetermined direction when a temperature of the belt frame is changed by 30 degrees Celsius is less than or equal to 50 micrometers.

16. A belt unit comprising:

a belt frame;

a plurality of belt support rollers supported by the belt frame;

a belt movably supported by the plurality of belt support rollers, the belt extending in a predetermined direction;

a transfer roller disposed in confrontation with the belt, the transfer roller having a roller shaft that extends in an axial direction and that has a diameter in a radial direction, the transfer roller being rotatable about the roller shaft; and a regulating member that is provided at an end of the roller shaft and that extends in the radial direction, wherein the transfer roller is mounted on the belt frame so as to be capable of displacing in the radial direction, and the belt frame is formed with a groove having an inner surface, the regulating member being configured to be fitted in the groove such that the regulating member is positioned with respect to the axial direction.

17. The belt unit according to claim 16, wherein the belt frame is formed with a roller-shaft insertion hole, the roller-shaft insertion hole having a size in the radial direction that is larger than the diameter of the roller shaft.

18. The belt unit according to claim 17, wherein the roller-shaft insertion hole is substantially rectangular.

19. The belt unit according to claim 16, wherein the regulating member has a contact surface that contacts the inner surface of the groove, the contact surface having a convex shape.

20. The belt unit according to claim 16, further comprising:

a second transfer roller disposed in confrontation with the belt, the second transfer roller having a second roller shaft that extends in an axial direction and that has a diameter in a radial direction, the second transfer roller being rotatable about the second roller shaft, wherein the second transfer roller is loosely mounted on the belt frame so as to be capable of displacing along the predetermined direction.

* * * * *

UNITED STATES PATENT AND TRADEMARK OFFICE

CERTIFICATE OF CORRECTION

PATENT NO. : 7,623,809 B2
APPLICATION NO. : 11/476912
DATED : November 24, 2009
INVENTOR(S) : Hiroshi Nakano et al.

It is certified that error appears in the above-identified patent and that said Letters Patent is hereby corrected as shown below:

On the title page:

In item "(56) References Cited", under "OTHER PUBLICATIONS", please change the document listed as follows:

"Japanese Office Action, w/English translation thereof, Issued in Japanese Patent Application No. 2005-189646 dated February 17, 2009"

To

"Japanese Office Action, w/English translation thereof, Issued in Japanese Patent Application No. 2005-189546 dated February 17, 2009."

Signed and Sealed this

Eighteenth Day of May, 2010

David J. Kappos

David J. Kappos
*Director of the United States Patent and Trademark Office*